US010786124B2

(12) United States Patent
Fujimura et al.

(10) Patent No.: US 10,786,124 B2
(45) Date of Patent: Sep. 29, 2020

(54) HAND DRYER

(71) Applicant: Mitsubishi Electric Corporation, Chiyoda-ku, Tokyo (JP)

(72) Inventors: Tatsuya Fujimura, Tokyo (JP); Ryoji Mori, Tokyo (JP); Yuki Fukuda, Tokyo (JP)

(73) Assignee: MITSUBISHI ELECTRIC CORPORATION, Chiyoda-ku, Tokyo (EP)

( * ) Notice: Subject to any disclaimer, the term of this patent is extended or adjusted under 35 U.S.C. 154(b) by 0 days.

(21) Appl. No.: 16/318,739

(22) PCT Filed: Aug. 26, 2016

(86) PCT No.: PCT/JP2016/074981
§ 371 (c)(1),
(2) Date: Jan. 18, 2019

(87) PCT Pub. No.: WO2018/037554
PCT Pub. Date: Mar. 1, 2018

(65) Prior Publication Data

US 2019/0239703 A1 Aug. 8, 2019

(51) Int. Cl.
*A47K 10/48* (2006.01)
*A47K 10/36* (2006.01)

(52) U.S. Cl.
CPC ..... *A47K 10/48* (2013.01); *A47K 2010/3668* (2013.01)

(58) Field of Classification Search
CPC . A47K 10/48; A47K 5/00; A47K 5/12; A47K 2010/3668; F26B 23/06;
(Continued)

(56) References Cited

U.S. PATENT DOCUMENTS 3,766,397 A * 10/1973 Rockson ..... A47K 10/48 250/432 R
5,031,337 A * 7/1991 Pilolla ..... A47K 10/48 34/202
(Continued)

FOREIGN PATENT DOCUMENTS

EP 2946708 A1 * 11/2015 ..... A47K 10/48
GB 2538647 A * 11/2016 ..... A47K 10/48
(Continued)

OTHER PUBLICATIONS

Extended European Search Report dated Jul. 16, 2019, for corresponding European patent application No. 16914228.8, 8 pages.
(Continued)

*Primary Examiner* — Stephen M Gravini
(74) *Attorney, Agent, or Firm* — Buchanan Ingersoll & Rooney PC

(57) ABSTRACT

A hand dryer includes: nozzles each provided on a wall of a hand insertion portion, transforming a high-pressure airflow from an air blower into a high-speed airflow, and blowing the high-speed airflow into the hand insertion portion. The hand dryer includes: a hand sensor including a plurality of electrode pairs and detecting a hand inserted into the hand insertion portion from a change in capacitance between two electrodes included in the plurality of electrode pairs, each of the plurality of electrode pairs consisting of a first electrode and a second electrode having different polarities to each other; and a controller that drives the air blower on the basis of a combination of the two electrodes with which a hand has been detected by the hand sensor.

10 Claims, 8 Drawing Sheets

(58) Field of Classification Search
CPC ..... F26B 25/00; F26B 21/00; F26B 21/06; B64D 4/02; B64D 2013/0629
USPC ..... 34/572
See application file for complete search history.

(56) References Cited

U.S. PATENT DOCUMENTS

| | | | | | |
|---|---|---|---|---|---|
| 5,459,944 | A * | 10/1995 | Tatsutani | A47K 10/48 | 34/202 |
| 6,038,786 | A * | 3/2000 | Aisenberg | A47K 10/48 | 34/202 |
| 7,039,301 | B1 * | 5/2006 | Aisenberg | A47K 10/48 | 34/201 |
| 7,971,368 | B2 * | 7/2011 | Fukaya | A47K 10/48 | 222/1 |
| 8,201,344 | B2 * | 6/2012 | Sawabe | A47K 10/48 | 132/73.5 |
| 8,481,470 | B2 * | 7/2013 | Jones, Jr. | G01N 1/2226 | 510/100 |
| 8,544,186 | B2 * | 10/2013 | Hsu | A47K 10/48 | 34/202 |
| 8,607,472 | B2 * | 12/2013 | Ishii | A47K 10/48 | 15/97.1 |
| 8,739,430 | B2 * | 6/2014 | Fukaya | A47K 10/48 | 34/202 |
| 8,813,383 | B2 * | 8/2014 | Liu | A47K 10/48 | 15/97.1 |
| 9,125,533 | B2 * | 9/2015 | Babikian | A47K 10/485 | |
| 9,441,885 | B2 * | 9/2016 | Bayley | A47K 4/00 | |
| 9,826,865 | B2 * | 11/2017 | Maruyama | A47K 10/48 | |
| 10,041,236 | B2 * | 8/2018 | Loberger | E03C 1/18 | |
| 10,085,601 | B2 * | 10/2018 | Fukano | A47K 10/48 | |
| 10,264,931 | B2 * | 4/2019 | Childress | B64D 11/02 | |
| 10,349,792 | B2 * | 7/2019 | Homma | A47K 10/48 | |
| 10,455,992 | B2 * | 10/2019 | Satermo | B64D 11/02 | |
| 2013/0263645 | A1 * | 10/2013 | Jones | G01N 1/2226 | 73/23.34 |
| 2013/0283629 | A1 * | 10/2013 | Bueker | A47K 10/48 | 34/60 |
| 2013/0341316 | A1 * | 12/2013 | Perez | A47K 10/48 | 219/220 |
| 2014/0152610 | A1 * | 6/2014 | Suwald | G01D 5/24 | 345/174 |
| 2014/0259735 | A1 * | 9/2014 | Muderlak | F26B 20/00 | 34/572 |
| 2015/0282682 | A1 * | 10/2015 | Bayley | E03C 1/01 | 4/638 |
| 2019/0239703 | A1 * | 8/2019 | Fujimura | A47K 10/48 | |
| 2020/0029753 | A1 * | 1/2020 | Jolin | H04L 67/26 | |
| 2020/0046179 | A1 * | 2/2020 | Satermo | B64D 11/02 | |

FOREIGN PATENT DOCUMENTS

| | | | | |
|---|---|---|---|---|
| JP | 5143223 | B2 * | 2/2013 | A47K 10/48 |
| JP | 2013099396 | A | 5/2013 | |
| JP | WO2012023294 | A1 * | 10/2013 | A47K 10/48 |
| JP | 2014117548 | A | 6/2014 | |
| KR | 101223773 | B1 * | 1/2013 | A47K 10/48 |
| KR | 20130040248 | A * | 4/2013 | A47K 10/48 |
| WO | 2015128989 | A1 | 9/2015 | |
| WO | 2015137123 | A1 | 9/2015 | |

OTHER PUBLICATIONS

International Search Report (PCT/ISA/210) dated Nov. 22, 2016, by the Japan Patent Office as the International Searching Authority for International Application No. PCT/JP2016/074981.

* cited by examiner

HAND DRYER

FIELD

The present invention relates to a hand dryer for drying wet hands.

BACKGROUND

In order to keep one's hands hygienic, the hands need to be washed and then dried hygienically. For this purpose, instead of wiping wet hands with a towel or handkerchief after washing, one uses a hand dryer that dries hands by blowing a high-speed airflow to the hands and blowing off water on the hands.

A hand sensor for this type of hand dryer uses a capacitive sensor which is not influenced by extraneous light such as sunlight or lighting, and hand sensing performance of which is not influenced by uncleanliness of a case surface.

The capacitive sensor detects a hand by measuring a change in capacitance between electrodes used in the sensor. The capacitive sensor uses a capacitive sensor of a mutual capacitance type which measures capacitance between a pair of electrodes disposed to face each other, as disclosed in Patent Literature 1.

CITATION LIST

Patent Literature

Patent Literature 1: Japanese Patent Application Laid-open No. 2014-117548

SUMMARY

Technical Problem

However, when the capacitive sensor with the pair of electrodes facing each other is used for the hand sensor as in Patent Literature 1, the sensor can detect a hand but cannot detect the position at which the hand is placed, thereby failing to perform control appropriate for the position at which the hand is placed.

The present invention has been made in view of the above, and an object of the invention is to provide a hand dryer capable of preventing misoperation due to water adhesion and controlling operation on the basis of a position at which a hand is placed.

Solution to Problem

A hand dryer according to an aspect of the present invention removes water adhering to a hand inserted into a hand insertion portion with a high-pressure airflow blown from a nozzle and includes: the hand insertion portion formed in a recessed shape in a body casing; an air blower provided in the body casing to generate the high-pressure airflow; and the nozzle provided on a wall of the hand insertion portion to transform the high-pressure airflow from the air blower into a high-speed airflow and blow the high-speed airflow into the hand insertion portion. The hand dryer further includes a hand sensor including a plurality of electrode pairs to detect a hand inserted into the hand insertion portion from a change in capacitance between two electrodes included in the plurality of electrode pairs, each of the plurality of electrode pairs consisting of a first electrode and a second electrode having different polarities to each other; and a controller to drive the air blower on the basis of a combination of the two electrodes with which a hand has been detected by the hand sensor.

Advantageous Effects of Invention

The hand dryer according to the present invention can prevent misoperation due to water adhesion and control operation on the basis of a position at which a hand is placed.

DESCRIPTION OF EMBODIMENTS

A hand dryer according to embodiments of the present invention will now be described in detail with reference to the drawings. Note that the present invention is not limited to the embodiments.

First Embodiment

Figure 1:
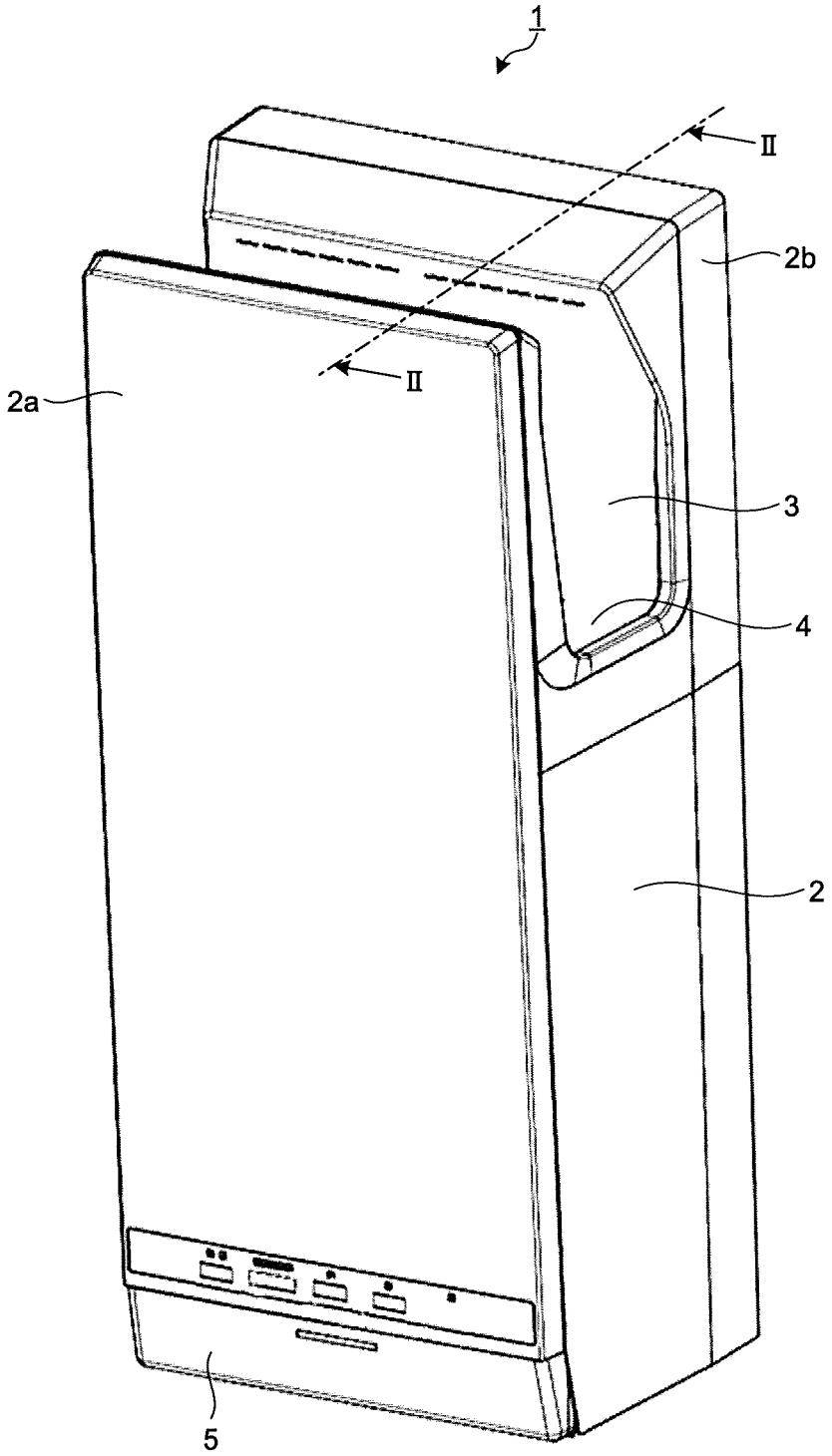
FIG. 1 is a perspective view of a hand dryer according to a first embodiment of the present invention.
Figure 2:
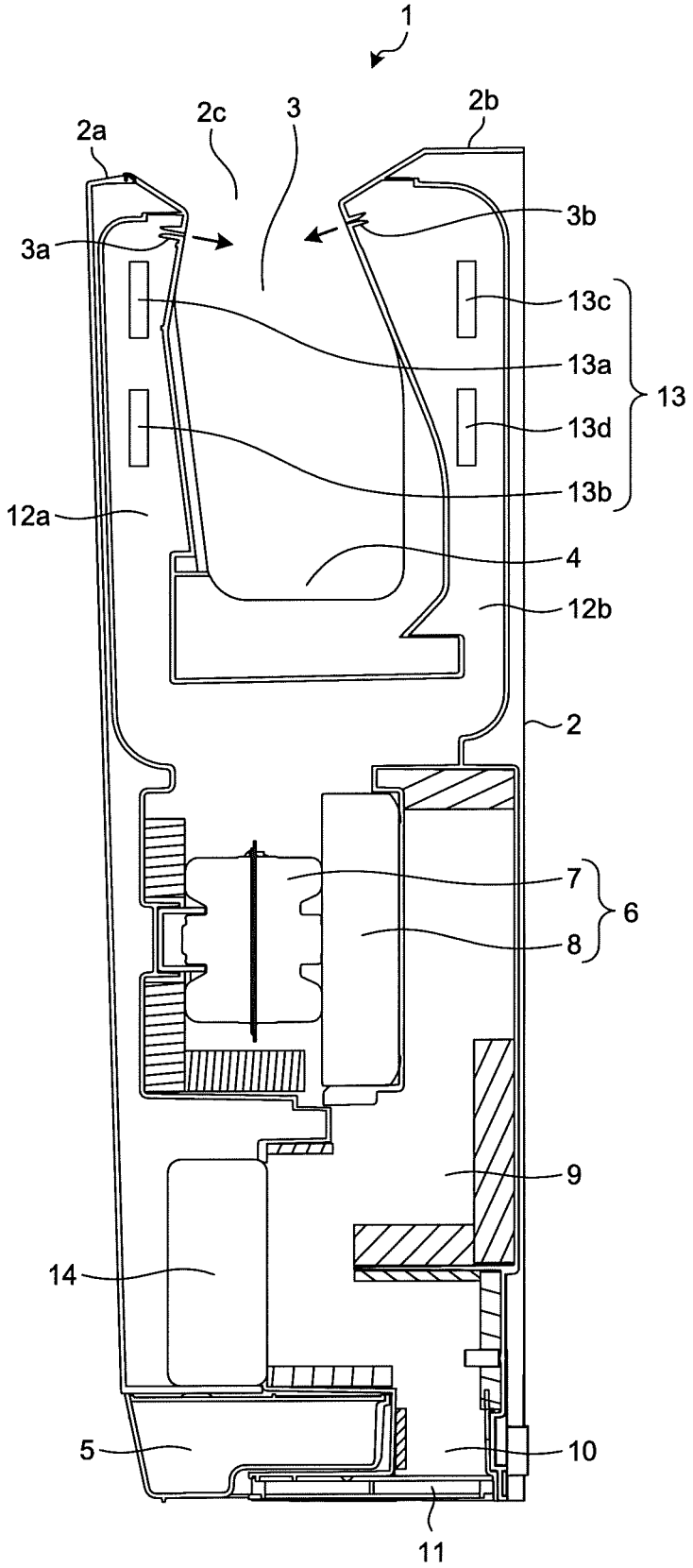
FIG. 2 is a cross-sectional view of the hand dryer according to the first embodiment of the present invention, the cross-sectional view being taken along line II-II of FIG. 1.
Figure 3:
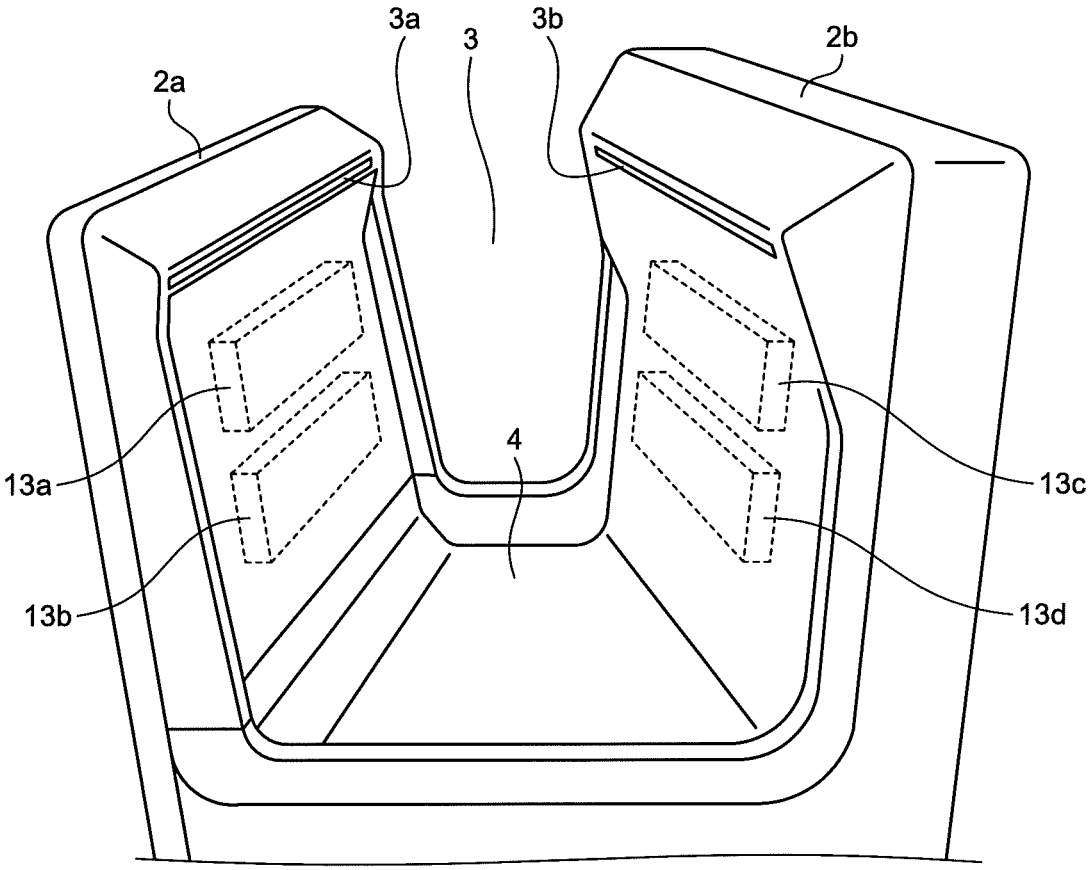
FIG. 3 is a top side view of the hand dryer according to the first embodiment of the present invention.

FIG. 1 is a perspective view of a hand dryer 1 according to a first embodiment of the present invention. FIG. 2 is a cross-sectional view of the hand dryer 1 according to the first embodiment of the present invention, the cross-sectional view being taken along line II-II of FIG. 1. FIG. 3 is a top side view of the hand dryer 1 according to the first embodiment of the present invention. Some parts in FIG. 3 are scaled to facilitate the understanding of the configuration of the hand dryer 1.

As illustrated in FIG. 2, the hand dryer 1 has an opening 2*c* provided in an upper part of a body casing 2 that forms the outer shell of the hand dryer 1. A hand insertion portion 3 is provided below the opening 2*c* in the upper part of the body casing 2, and the hand insertion portion 3 is a space formed in a recessed shape to cover a user's hand inserted from the opening 2*c*. The hand insertion portion 3 has a U-shaped cross section in a side view and is slightly tilted from a front side to a back side toward a lower part of the hand insertion portion 3 relative to an upper part thereof. Here, the front side of the hand dryer 1 corresponds to a near side in FIG. 1 and a left side in FIG. 2.

The hand insertion portion 3 is the space between a front protrusion 2*a* which is an overhanging portion on the front side, that is, on the side closer to a user, and a rear protrusion 2*b* which is an overhanging portion on the back side, that is, on the side away from a user. The front protrusion 2*a* and the rear protrusion 2*b* are connected to a water receiving portion 4 provided at the bottom of the hand insertion portion 3. The hand insertion portion 3 thus has a bottomed U-shaped cross section with the upper part open in the side view. As illustrated in FIG. 1, both side surfaces of the hand insertion portion 3 in the width direction are open. The hand insertion portion 3 can thus allow a user to freely insert or remove his hand into or from the hand insertion portion from above or the sides.

A drain outlet (not illustrated) is provided in a part of the water receiving portion 4 and drains water in the water receiving portion 4. The drain outlet is attached to an upper end of a drain passage (not illustrated) extending vertically in the body casing 2. A lower end of the drain passage is connected to a drain tank 5 disposed at the bottom of the body. The drain tank 5 stores water discharged through the drain passage, and is detachably attached to the bottom of the body casing 2. The drain outlet is sloped for allowing water to flow downward so that water adhering to the water receiving portion 4 flows through the drain passage and is stored in the drain tank 5.

An air blower 6 that generates a high-speed airflow is installed below the hand insertion portion 3 inside the body casing 2 as illustrated in FIG. 2. The air blower 6 is formed by a high-pressure airflow generator including a motor 7 and a turbofan 8 rotated by the motor 7. The air blower 6 is disposed with an intake side placed on the back surface of the air blower 6 and an exhaust side placed on the front surface of the air blower 6.

The intake side of the air blower 6 communicates with an upper part of a duct 9 which is an internal air passage defined on the back side in the body casing 2 and extending vertically. A lower end of the duct 9 opens downward as an air inlet 10. An air filter 11 is disposed to the air inlet 10. As a result, outside air can be taken into the duct 9 through the air filter 11.

The exhaust side of the air blower 6 communicates with a lower part of a front exhaust duct 12*a* and a back exhaust duct 12*b* which extend vertically inside the body casing 2 and branch off to be defined on the front side and the back side. High-pressure air pressurized in the air blower 6 is discharged to the front exhaust duct 12*a* and the back exhaust duct 12*b* connected to the air blower 6. A heater may be installed below where the front exhaust duct 12*a* and the back exhaust duct 12*b* branch off to the front side and the back side to raise the temperature of the high-pressure air passing therethrough.

A front side nozzle 3*a* and a back side nozzle 3*b* as outlets are provided in the upper parts of the front exhaust duct 12*a* and the back exhaust duct 12*b*, respectively. That is, in the hand insertion portion 3, the front side nozzle 3*a* which is a hand drying nozzle for blowing air out is provided on the inner wall of the front protrusion 2*a* near the opening 2*c*, and the back side nozzle 3*b* which is a hand drying nozzle for blowing air out is provided on the inner wall of the rear protrusion 2*b* near the opening 2*c*. The front side nozzle 3*a* and the back side nozzle 3*b* face each other across the hand insertion portion 3. The front side nozzle 3*a* and the back side nozzle 3*b* each include a plurality of small holes whose openings are somewhat wavy and face downward at an angle. The small holes are arranged in a row in the horizontal direction, that is, in the width direction of the hand dryer 1 in front view.

The front side nozzle 3*a* and the back side nozzle 3*b* transform the high-pressure air generated by the air blower 6 into high-speed airflow, and blow the high-speed airflow as a working airflow toward the hand insertion portion 3 from the outlets. The front side nozzle 3*a* and the back side nozzle 3*b* blow the working airflow toward each other into the hand insertion portion 3 at a slightly downward angle relative to the horizontal, thereby blowing off water adhering to the wrist or the palm or back of a user's hand inserted into the hand insertion portion 3 below the hand insertion portion 3.

A hand sensor 13 is incorporated in the front protrusion 2*a* below the front side nozzle 3*a* and in the rear protrusion 2*b* below the back side nozzle 3*b*. When a user inserts his wet hand deeper into the hand insertion portion 3 from the opening 2*c*, the hand sensor 13 detects the hand being inserted and detects that the user's hand is inserted into the hand insertion portion 3. Upon detecting that the user's hand is inserted into the hand insertion portion 3, the hand sensor 13 outputs a hand detection signal to the effect that the user's hand is detected to a controller 14 which will be described later. Details of the hand sensor 13 will be described later.

Figure 4:
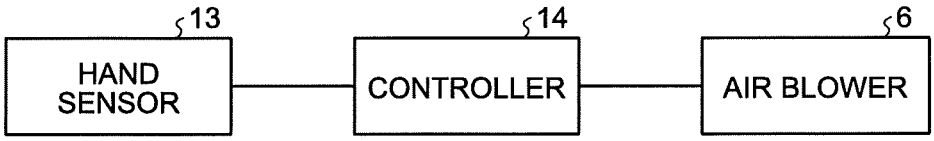
FIG. 4 is a functional block diagram of a main part related to control of the hand dryer according to the first embodiment of the present invention.

The controller 14 is embedded in the lower part of the body casing 2 and controls the operation of the air blower 6 in response to hand detection by the hand sensor 13. The controller 14 controls the operation of the air blower 6 on the basis of hand detection signal information output from the hand sensor 13, and causes the front side nozzle 3*a* and the back side nozzle 3*b* to blow air into the hand insertion portion 3. FIG. 4 is a functional block diagram of a main part related to control of the hand dryer 1 according to the first embodiment of the present invention.

Figure 5:
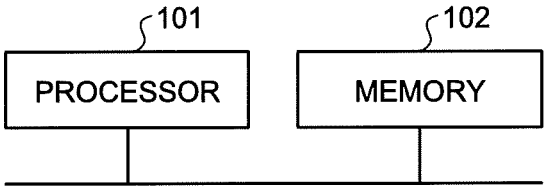
FIG. 5 is a diagram illustrating an example of the hardware configuration of a processing circuit according to the first embodiment of the present invention.

The controller 14 is implemented as a processing circuit having the hardware configuration illustrated in FIG. 5, for example. FIG. 5 is a diagram illustrating an example of the hardware configuration of the processing circuit according to the first embodiment of the present invention. The controller 14 is implemented as the processing circuit with the hardware configuration illustrated in FIG. 5 when a processor 101 illustrated in FIG. 5 executes a program stored in a memory 102, for example. Alternatively, a plurality of processors and a plurality of memories may cooperatively implement the above functions. Yet alternatively, some of the functions of the controller 14 may be implemented as an electronic circuit, and the other functions may be implemented by using the processor 101 and the memory 102.

Next, the hand sensor 13 will be described. The hand sensor 13 uses a capacitive sensor of a mutual capacitance type. The capacitive sensor includes a plurality of electrodes and a circuit (not illustrated) that is connected to the electrodes and detects a change in capacitance between the electrodes. As illustrated in FIGS. 2 and 3, the front protrusion 2*a* includes an electrode 13*a* and an electrode 13*b* disposed below the electrode 13*a* that configure the capacitive sensor. Moreover, as illustrated in FIGS. 2 and 3, the rear protrusion 2*b* includes an electrode 13*c* and an electrode 13*d* disposed below the electrode 13*c* that configure the capacitive sensor. The electrodes 13*a* and 13*c* are disposed to face each other. That is, the electrodes 13*a* and 13*c* are disposed such that main surfaces thereof face each other across the hand insertion portion 3. The electrodes 13*b* and 13*d* are disposed to face each other. That is, the electrodes 13*b* and 13*d* are disposed such that main surfaces thereof face each other across the hand insertion portion 3. Here, the description "the main surfaces thereof face each other" refers to a state in which the main surfaces of the electrodes face each other. The main surface is a principal surface having the area larger than the area of another surface of each electrode.

Moreover, the electrodes 13*a* and 13*b* are disposed such that the main surfaces thereof are positioned vertically on a plane. The electrodes 13*c* and 13*d* are disposed such that the main surfaces thereof are positioned vertically on a plane. That is, in the first embodiment, two electrode pairs are disposed such that a first electrode and a second electrode in each electrode pair face each other across the hand insertion portion 3 in a depth direction of the body casing 2 and, in each electrode pairs, one electrode is disposed vertically adjacent to an electrode in another electrode pair on a plane, the vertically adjacent electrodes having different polarities.

Here, the description "the main surfaces are positioned on a plane" refers to a state in which the main surfaces of the electrodes 13*c* and 13*d* are parallel to each other while side surfaces thereof face each other. In the first embodiment, the electrodes 13*a*, 13*b*, 13*c*, and 13*d* are each in the shape of a rectangular parallelepiped and have the same shape and size. However, the shape and size of each electrode can be changed as appropriate.

Figure 6:
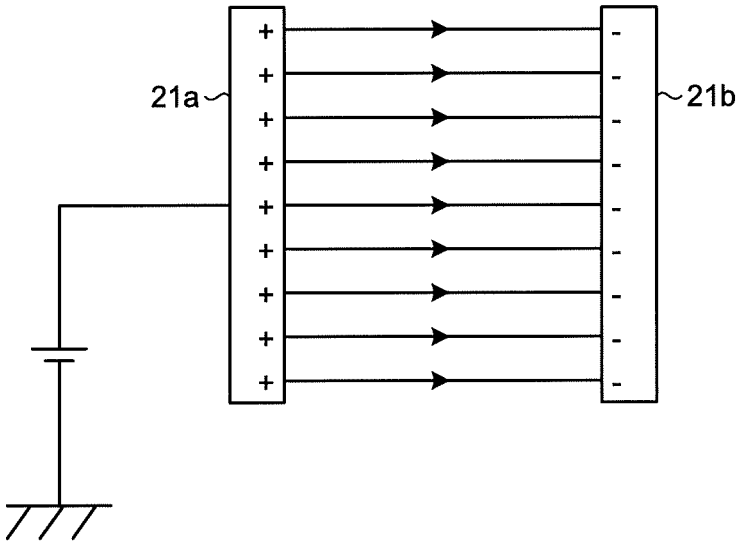
FIG. 6 is a schematic diagram for explaining the principle of a capacitive sensor of a mutual capacitance type that forms a hand sensor of the hand dryer according to the first embodiment of the present invention.

FIG. 6 is a schematic diagram for explaining the principle of the capacitive sensor of the mutual capacitance type that configures the hand sensor 13 of the hand dryer 1 according to the first embodiment of the present invention. The capacitive sensor of the mutual capacitance type includes the circuit that detects a change in capacitance between the electrodes, where the circuit applies a voltage to a transmitting electrode to form an electric field with a receiving electrode. As a fingertip approaches the electrodes, a part of the electric field moves toward the fingertip so that the electric field detected by the receiving electrode and therefore the capacitance decrease. The circuit recognizes the decrease in capacitance at this time by detecting the change in capacitance between the electrodes, thereby detecting the approach of the fingertip. The circuit stores capacitance between the electrodes in the absence of a fingertip approaching.

Figure 7:
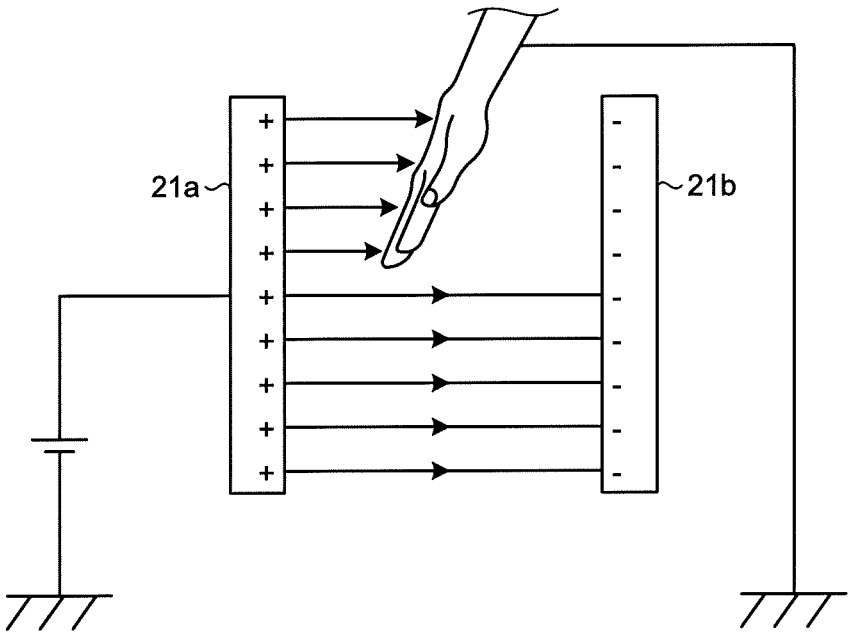
FIG. 7 is a schematic diagram for explaining the principle of the capacitive sensor of the mutual capacitance type that forms the hand sensor of the hand dryer according to the first embodiment of the present invention.

FIG. 6 illustrates a state of a capacitive sensor of a mutual capacitance type in the absence of a hand approaching the sensor, where the capacitive sensor includes a pair of electrodes 21*a* and 21*b* disposed with main surfaces thereof facing each other. FIG. 7 is a schematic diagram for explaining the principle of the capacitive sensor of the mutual capacitance type that configures the hand sensor 13 of the hand dryer 1 according to the first embodiment of the present invention. FIG. 7 illustrates a state of the capacitive sensor of the mutual capacitance type in the presence of a hand approaching the sensor, where the capacitive sensor includes the pair of electrodes 21*a* and 21*b* disposed with the main surfaces thereof facing each other.

As illustrated in FIG. 6, a voltage is applied to the electrode 21*a* to form an electric field with the electrode 21*b*, and capacitance formed between the electrodes 21*a* and 21*b* is measured. The sensor can be used as a sensor for detecting a hand inserted between the electrodes 21*a* and 21*b* by disposing the electrodes 21*a* and 21*b* that face each other and measuring capacitance between the electrodes 21*a* and 21*b*. When a potential difference is generated between the electrodes 21*a* and 21*b*, an electric field is formed between the electrodes 21*a* and 21*b* due to capacitive coupling. The magnitude of capacitance is inversely proportional to the distance between the electrodes 21*a* and 21*b*, so that capacitance increases when a conductor such as metal is inserted therebetween. Capacitance between the electrodes 21*a* and 21*b* also increases when a dielectric or substance such as water having a higher dielectric constant than air is inserted.

Then, when a conductor which is a part of a human body such as a hand approaches or is inserted between the electrodes 21*a* and 21*b* as illustrated in FIG. 7, a part of the electric field is induced by the human body so that capacitance between the electrodes 21*a* and 21*b* decreases. That is, the human body approaching or inserted between the electrodes 21*a* and 21*b* can be regarded as being grounded to thus achieve electrostatic shielding and cause the decrease in capacitance between the electrodes 21*a* and 21*b*. As a result, a hand can be detected by periodically measuring capacitance between the electrodes 21*a* and 21*b* and detecting a change in capacitance.

Figure 8:
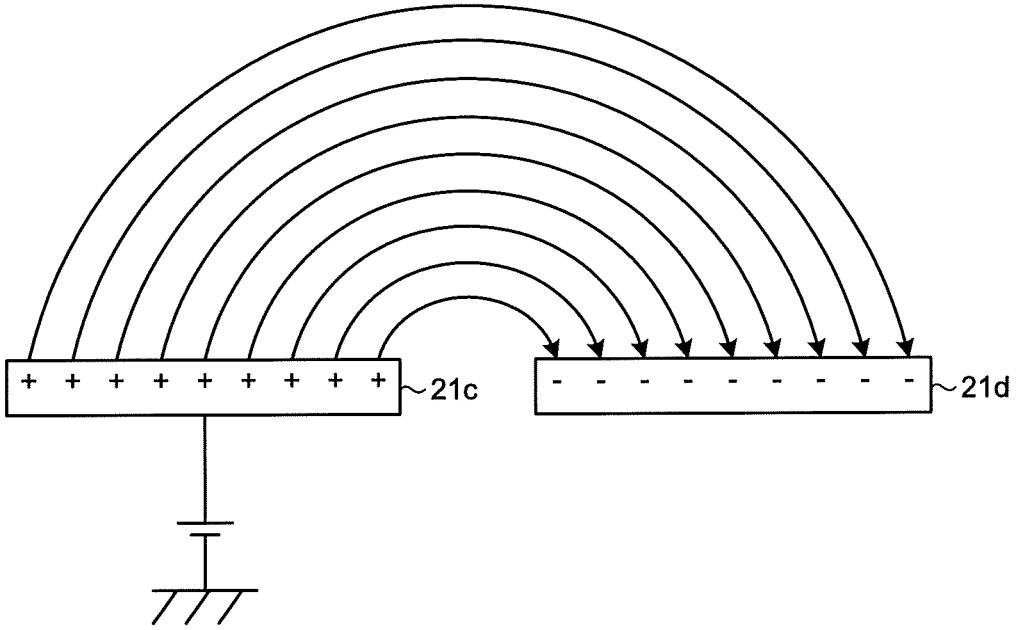
FIG. 8 is a schematic diagram for explaining the principle of the capacitive sensor of the mutual capacitance type that forms the hand sensor of the hand dryer according to the first embodiment of the present invention.
Figure 9:
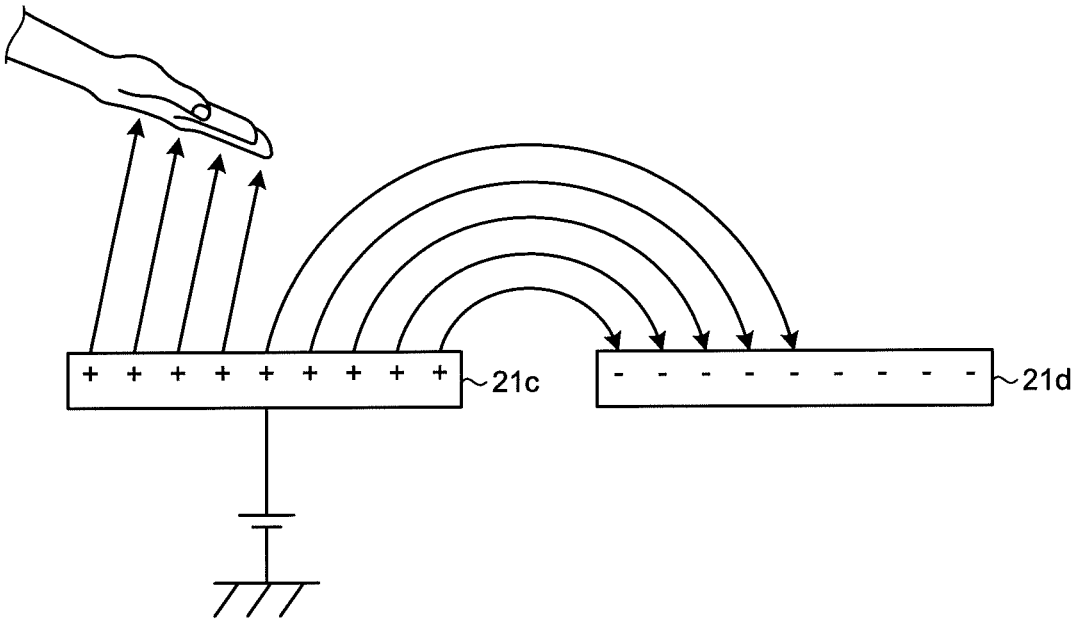
FIG. 9 is a schematic diagram for explaining the principle of the capacitive sensor of the mutual capacitance type that forms the hand sensor of the hand dryer according to the first embodiment of the present invention.

FIG. 8 is a schematic diagram for explaining the principle of the capacitive sensor of the mutual capacitance type that configures the hand sensor 13 of the hand dryer 1 according to the first embodiment of the present invention. FIG. 8 illustrates a state of the capacitive sensor of the mutual capacitance type in the absence of a hand approaching the sensor, where the capacitive sensor includes a pair of electrodes 21*c* and 21*d* with main surfaces thereof disposed on a plane. FIG. 9 is a schematic diagram for explaining the principle of the capacitive sensor of the mutual capacitance type that configures the hand sensor 13 of the hand dryer 1 according to the first embodiment of the present invention. FIG. 9 illustrates a state of the capacitive sensor of the mutual capacitance type in the presence of a hand approaching the sensor, where the capacitive sensor includes the pair of electrodes 21*c* and 21*d* with the main surfaces thereof disposed on a plane. Here, the description "the main surfaces thereof disposed on a plane" refers to a state in which the main surfaces of the electrodes 21*c* and 21*d* are parallel to each other while side surfaces thereof face each other.

As illustrated in FIG. 8, a voltage is applied to the electrode 21*c* to form an electric field with the electrode 21*d*, and capacitance formed between the electrodes 21*c* and 21*d* is measured. The sensor can be used as a sensor for detecting a hand approaching the electrodes 21*c* and 21*d* by disposing the planes of the electrodes 21*c* and 21*d* parallel to each other and measuring capacitance between the electrodes 21*c* and 21*d*. When a potential difference is generated between the electrodes 21*c* and 21*d*, an electric field is formed between the electrodes 21*c* and 21*d* due to capacitive coupling. The magnitude of capacitance is inversely proportional to the distance between the electrodes 21*c* and 21*d*, so that capacitance increases when a conductor such as metal approaches the electrodes. Capacitance between the electrodes 21*c* and 21*d* also increases when a dielectric such as water with a higher dielectric constant than air approaches the electrodes.

Here, when a conductor which is a part of a human body such as a hand approaches the electrodes 21*c* and 21*d* as illustrated in FIG. 9, a part of the electric field is induced by the human body so that capacitance between the electrodes 21*c* and 21*d* decreases. That is, the human body approaching the electrodes 21*c* and 21*d* can be regarded as being grounded to thus achieve electrostatic shielding and cause the decrease in capacitance between the electrodes 21*c* and

21*d*. As a result, a hand can be detected by periodically detecting capacitance between the electrodes 21*c* and 21*d* and detecting a change in the capacitance. That is, the hand sensor 13 includes a plurality of electrode pairs each consisting of two electrodes having different polarities to each other and disposes the pairs at different positions, thereby detecting a hand inserted into the hand insertion portion 3 on the basis of a change in capacitance between the electrodes.

As described above, capacitance of the capacitive sensor of the mutual capacitance type increases when a dielectric or substance such as water having a higher dielectric constant than air adheres to the surface of at least one of the two electrodes. On the other hand, capacitance decreases when a part of a human body such as a hand approaches or is inserted between the two electrodes. The capacitive sensor of the mutual capacitance type can thus distinguish the difference between a state in which a hand approaches or is inserted between the electrodes and a state in which a dielectric such as water adheres to the surface of at least one of the two electrodes. That is, the capacitive sensor of the mutual capacitance type can accurately discriminate a case in which a hand approaches or is inserted between the electrodes from a case in which a dielectric such as water adheres to the surface of at least one of the two electrodes.

The hand sensor 13 using such a capacitive sensor of the mutual capacitance type detects a hand by detecting capacitance between two of the electrodes 13*a*, 13*b*, 13*c*, and 13*d*. That is, the hand sensor 13 determines insertion of a hand and the position of a hand inserted into the hand insertion portion 3 by switching a combination of the two electrodes, which are used for detecting a change in capacitance, in turn among four patterns. The hand sensor 13 detects a change in capacitance between the two electrodes in four detection patterns that are a first pattern to a fourth pattern.

In the first pattern, the hand sensor 13 detects capacitance between the electrodes 13*a* and 13*b* disposed vertically adjacent to each other on a plane at predetermined regular intervals, thereby detecting a change in capacitance between the electrodes 13*a* and 13*b* and detecting whether or not a hand is inserted into a front side of the hand insertion portion 3, i.e., whether or not a hand is inserted on the side of the front protrusion 2*a* in the hand insertion portion 3. In this case, the electrodes 13*a* and 13*b* correspond to the electrodes 21*c* and 21*d* in FIGS. 8 and 9, respectively. The electrodes 13*a* and 13*b* are disposed on the same plane.

In the second pattern, the hand sensor 13 detects capacitance between the electrodes 13*c* and 13*d* disposed vertically adjacent to each other on a plane at predetermined regular intervals, thereby detecting a change in capacitance between the electrodes 13*c* and 13*d* and detecting whether or not a hand is inserted into a back side of the hand insertion portion 3, i.e., whether or not a hand is inserted on the side of the rear protrusion 2*b* in the hand insertion portion 3. In this case, the electrodes 13*c* and 13*d* correspond to the electrodes 21*c* and 21*d* in FIGS. 8 and 9, respectively. The electrodes 13*c* and 13*d* are disposed on the same plane.

In the third pattern, the hand sensor 13 detects capacitance between the electrodes 13*a* and 13*c* disposed to face each other across the hand insertion portion 3 at predetermined regular intervals, thereby detecting a change in capacitance between the electrodes 13*a* and 13*c* and detecting whether or not a hand is inserted into an upper side of the hand insertion portion 3, i.e., whether or not a hand is inserted on the side of the opening 2*c* in the hand insertion portion 3. In this case, the electrodes 13*a* and 13*c* correspond to the electrodes 21*a* and 21*b* in FIGS. 6 and 7, respectively.

In the fourth pattern, the hand sensor 13 detects capacitance between the electrodes 13*b* and 13*d* disposed to face each other across the hand insertion portion 3 at predetermined regular intervals, thereby detecting a change in capacitance between the electrodes 13*b* and 13*d* and detecting whether or not a hand is inserted into a lower side of the hand insertion portion 3, i.e., whether or not a hand is inserted on the side of the water receiving portion 4 in the hand insertion portion 3. In this case, the electrodes 13*b* and 13*d* correspond to the electrodes 21*a* and 21*b* in FIGS. 6 and 7, respectively.

In the four detection patterns that includes the first to fourth patterns, the first embodiment uses the electrodes 13*a* and 13*d* as positive electrodes and the electrodes 13*b* and 13*c* as negative electrodes. The positive electrode corresponds to the electrode 21*a* in FIGS. 6 and 7 or the electrode 21*c* in FIGS. 8 and 9. When detecting a change in capacitance between the electrodes in the above four detection patterns, the hand sensor 13 switches the combination of the electrodes which are used for detecting a change in capacitance. Thus, when capacitance between the electrodes is detected for the four combinations of the electrodes described above, the polarity of each electrode need not be changed, that is, the polarity of each electrode need not be changed to the positive side or the negative side, so that the time for detecting a hand can be reduced.

As described above, the hand sensor detects whether or not a hand is inserted into the hand insertion portion 3 at four points being the front side, the back side, the upper side, and the lower side of the hand insertion portion 3, thereby being able to determine the position of a hand inserted into the hand insertion portion 3 in two dimensions being the depth direction and the vertical direction. As a result, a specific position of a hand inserted in the hand insertion portion 3 can be detected.

The capacitive sensor of the mutual capacitance type requires a pair of electrodes and requires eight electrodes to detect capacitance at four points (4×2=8 electrodes). The first embodiment switches the combination of the pair of electrodes to be able to detect capacitance at the four points using the four electrodes and prevent an increase in the number of electrodes.

The hand sensor 13 uses the capacitive sensor of the mutual capacitance type so that capacitance between the electrodes increases when a dielectric such as water adheres to the surface of the electrode, and decreases when a part of a human body such as a hand is inserted between the electrodes. Thus, the hand sensor 13 can accurately discriminate a case in which a hand approaches or is inserted between the electrodes from a case in which a dielectric such as water adheres to the surface of at least one of the two electrodes.

The controller 14 controls the operation of the air blower 6 on the basis of information based on the hand detection signal information output from the hand sensor 13. The controller 14 operates the air blower 6 when the hand sensor 13 detects that a hand is inserted into the hand insertion portion 3. The controller 14 stops the air blower 6 when the hand sensor 13 detects that a hand is not inserted in either the lower or upper side of the hand insertion portion 3.

The high-pressure airflow generated by the air blower 6 is guided to the front side nozzle 3*a* which is a hand drying nozzle provided on the front side wall of the hand insertion portion 3 and the back side nozzle 3*b* which is a hand drying nozzle provided on the back side wall of the hand insertion portion 3, and then blown into the hand insertion portion 3 as the high-speed airflow from the front side nozzle 3*a* and the back side nozzle 3*b*. Then, the high-speed airflow blown into the hand insertion portion 3 blows off water adhering to a hand inserted into the hand insertion portion 3, thereby drying the hand.

The controller 14 controls distribution of supply of the high-pressure airflow to the front side nozzle 3*a* and the back side nozzle 3*b* on the basis of a combination of two electrodes with which a hand is detected in the hand insertion portion 3. The controller 14 processes the hand detection signal information output from the hand sensor 13 to determine the combination of the two electrodes with which the hand is detected and thus the position of the hand inserted in the hand insertion portion 3. When the hand is detected to be inserted into the front side of the hand insertion portion 3 during operation of the air blower 6, the controller 14 reduces the high-pressure airflow to the front side nozzle 3*a* and increases the high-pressure airflow to the back side nozzle 3*b*. In contrast, when the hand is detected to be inserted into the back side of the hand insertion portion 3 during operation of the air blower 6, the controller 14 increases the high-pressure airflow to the front side nozzle 3*a* and reduces the high-pressure airflow to the back side nozzle 3*b*. The distribution of supply of the high-pressure airflow to the front side nozzle 3*a* and the back side nozzle 3*b* is changed depending on the position of the hand inserted, whereby the hand dryer can evenly and efficiently dry the palm and back of the hand that is inserted into any position in the depth direction of the hand insertion portion 3.

A method of reducing the high-pressure airflow to the front side nozzle 3*a* and increasing the high-pressure airflow to the back side nozzle 3*b*, or a method of increasing the high-pressure airflow to the front side nozzle 3*a* and reducing the high-pressure airflow to the back side nozzle 3*b* is not limited to a particular method. In order to reduce the high-pressure airflow to the front side nozzle 3*a* and increase the high-pressure airflow to the back side nozzle 3*b*, the controller may reduce the supply of the high-pressure airflow to the front exhaust duct 12*a* and increase the supply of the high-pressure airflow to the back exhaust duct 12*b*. In contrast, in order to increase the high-pressure airflow to the front side nozzle 3*a* and reduce the high-pressure airflow to the back side nozzle 3*b*, the controller may increase the supply of the high-pressure airflow to the front exhaust duct 12*a* and reduce the supply of the high-pressure airflow to the back exhaust duct 12*b*.

The above control may be performed by arranging, for example, a movable guide plate that guides the high-pressure airflow generated by the air blower 6, in which case the controller 14 may adjust the supply of the high-pressure airflow to the front exhaust duct 12*a* and the back exhaust duct 12*b* by controlling the orientation of the guide plate. Alternatively, the controller 14 may adjust the supply of the high-pressure airflow to the front exhaust duct 12*a* and the back exhaust duct 12*b* by performing control that closes a part of the front exhaust duct 12*a* or a part of the back exhaust duct 12*b*. Yet alternatively, the air blower may be provided separately for each of the front exhaust duct 12*a* and the back exhaust duct 12*b*, in which case the controller 14 may control the amount of high-pressure airflow generated by each air blower.

As described above, the hand dryer 1 according to the first embodiment includes the electrode 13*a* on the upper side of the front side wall of the hand insertion portion 3 and the electrode 13*b* on the lower side of the front side wall, as viewed from the front side. The hand dryer further includes the electrode 13*c* on the upper side of the back side wall of the hand insertion portion 3 and the electrode 13*d* on the lower side of the back side wall, as viewed from the front side. The hand sensor 13 switches the combination of the two electrodes which are used for detecting a change in capacitance, thereby detecting whether or not a hand is inserted into the hand insertion portion 3 at four points that are the front side, the back side, the upper side, and the lower side of the hand insertion portion 3.

That is, the hand dryer 1 detects whether or not a hand is inserted into the hand insertion portion 3 by detecting a change in capacitance between the two electrodes disposed with the main surfaces thereof facing each other across the hand insertion portion 3 and a change in capacitance between the two electrodes disposed vertically adjacent to each other on a plane. The hand dryer 1 can therefore determine the position of a hand inserted in the hand insertion portion 3 in two dimensions that are the depth direction and the vertical direction. As a result, a specific position of a hand inserted in the hand insertion portion 3 can be detected.

The controller 14 controls the operation of the air blower 6 depending on the position of a hand in the hand insertion portion 3 detected by the hand sensor 13. That is, the controller 14 changes the distribution of supply of the high-pressure airflow to the front side nozzle 3*a* and the back side nozzle 3*b* depending on the position of the hand inserted in the hand insertion portion 3, thereby being able to evenly dry the palm and back of the hand that is inserted into any position in the depth direction of the hand insertion portion 3.

Moreover, the hand dryer 1 switches the combination of the pair of electrodes which are used for detecting a change in capacitance, thereby being able to detect capacitance at four points in the hand insertion portion 3 using the four electrodes and prevent an increase in the number of electrodes.

Therefore, the hand dryer 1 according to the first embodiment can avoid an increase in size and cost of the dryer by preventing an increase in the number of electrodes, and at the same time prevent misoperation due to water adhesion and be a user-friendly hand dryer that can perform control to achieve optimal operation corresponding to the position of a hand inserted.

Second Embodiment

Figure 10:
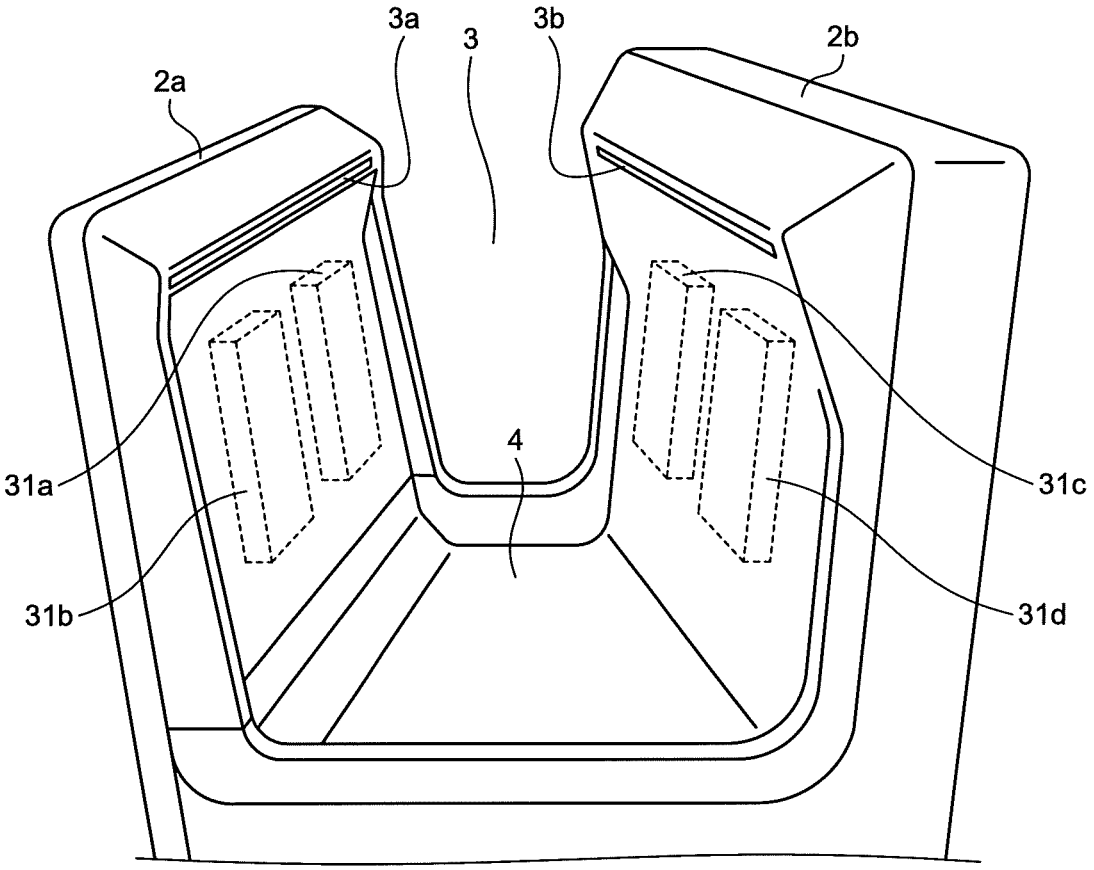
FIG. 10 is a top side view of a hand dryer according to a second embodiment of the present invention.

FIG. 10 is a top side view of a hand dryer according to a second embodiment of the present invention. Some parts in FIG. 10 are scaled to facilitate the understanding of the configuration of the hand dryer 1. The hand dryer according to the second embodiment illustrated in FIG. 10 is different from the hand dryer 1 according to the first embodiment in that a pair of electrodes on a plane is disposed not vertically but laterally, that is, horizontally, adjacent to each other on the plane as viewed from the front side.

Note that items not specifically described in the second embodiment are assumed to be similar to the items in the first embodiment, and functions and configurations identical to the functions and configurations in the first embodiment will be mentioned using the same reference numerals as the reference numerals assigned to the corresponding functions and configurations in the first embodiment. The functions and configurations of the hand dryer according to the second embodiment that are identical to the functions and configurations of the hand dryer 1 according to the first embodiment will not be described.

In the second embodiment, the hand sensor 13 includes electrodes 31*a*, 31*b*, 31*c*, and 31*d* as electrodes that configure the capacitive sensor of the mutual capacitance type instead of the electrodes 13*a*, 13*b*, 13*c*, and 13*d* in the first embodiment. The electrode 31*a* is provided in the front protrusion 2*a* on a left side thereof as viewed from the front side. The electrode 31*b* is provided in the front protrusion 2*a* on a right side thereof as viewed from the front side. The electrode 31*c* is provided in the rear protrusion 2*b* on a left side thereof as viewed from the front side. The electrode 31*d* is provided in the rear protrusion 2*b* on a right side thereof as viewed from the front side.

The electrodes 31*a* and 31*c* are disposed such that main surfaces thereof face each other across the hand insertion portion 3. The electrodes 31*b* and 31*d* are disposed such that main surfaces thereof face each other across the hand insertion portion 3. Moreover, the electrodes 31*a* and 31*b* are disposed such that the main surfaces thereof are positioned laterally on a plane. The electrodes 31*c* and 31*d* are disposed such that the main surfaces thereof are positioned laterally on a plane. That is, in the second embodiment, two electrode pairs are disposed such that a first electrode and a second electrode in each electrode pair face each other across the hand insertion portion 3 in a depth direction of the body casing 2 and, in each electrode pair, one electrode is disposed laterally adjacent to an electrode in another electrode pair on a plane, the laterally adjacent electrodes having different polarities to each other.

In the second embodiment, the electrodes 31*a*, 31*b*, 31*c*, and 31*d* are each in the shape of a rectangular parallelepiped and have the same shape and size. However, the shape and size of each electrode can be changed as appropriate.

In the second embodiment, the hand sensor 13 detects a hand by detecting capacitance between two of the electrodes 31*a*, 31*b*, 31*c*, and 31*d*. That is, the hand sensor 13 determines insertion of a hand and the position of a hand inserted into the hand insertion portion 3 by switching a combination of the two electrodes which are used for detecting a change in capacitance, in turn among four patterns. The hand sensor 13 detects a change in capacitance between the two electrodes in four detection patterns being a fifth pattern to an eighth pattern.

In the fifth pattern, the hand sensor 13 detects capacitance between the electrodes 31*a* and 31*b* disposed laterally adjacent to each other on a plane at predetermined regular intervals, thereby detecting a change in capacitance between the electrodes 31*a* and 31*b* and detecting whether or not a hand is inserted into the front side of the hand insertion portion 3, i.e., whether or not a hand is inserted on the side of the front protrusion 2*a* in the hand insertion portion 3. In this case, the electrodes 31*a* and 31*b* correspond to the electrodes 21*c* and 21*d* in FIGS. 8 and 9, respectively. The electrodes 31*a* and 31*b* are disposed on the same plane.

In the sixth pattern, the hand sensor 13 detects capacitance between the electrodes 31*c* and 31*d* disposed laterally adjacent to each other on a plane at predetermined regular intervals, thereby detecting a change in capacitance between the electrodes 31*c* and 31*d* and detecting whether or not a hand is inserted into the back side of the hand insertion portion 3, i.e., whether or not a hand is inserted on the side of the rear protrusion 2*b* in the hand insertion portion 3. In this case, the electrodes 31*c* and 31*d* correspond to the electrodes 21*c* and 21*d* in FIGS. 8 and 9, respectively. The electrodes 31*c* and 31*d* are disposed on the same plane.

In the seventh pattern, the hand sensor 13 detects capacitance between the electrodes 31*a* and 31*c* disposed to face each other across the hand insertion portion 3 at predetermined regular intervals, thereby detecting a change in capacitance between the electrodes 31*a* and 31*c* and detecting whether or not a hand is inserted into a region on a left side of the hand insertion portion 3 as viewed from the front side. In this case, the electrodes 31*a* and 31*c* correspond to the electrodes 21*a* and 21*b* in FIGS. 6 and 7, respectively.

In the eighth pattern, the hand sensor 13 detects capacitance between the electrodes 31*b* and 31*d* disposed to face each other across the hand insertion portion 3 at predetermined regular intervals, thereby detecting a change in capacitance between the electrodes 31*b* and 31*d* and detecting whether or not a hand is inserted into a region on a right side of the hand insertion portion 3 as viewed from the front side. In this case, the electrodes 31*b* and 31*d* correspond to the electrodes 21*a* and 21*b* in FIGS. 6 and 7, respectively.

In the four detection patterns being the fifth to eighth patterns, the second embodiment uses the electrodes 31*a* and 31*d* as positive electrodes and the electrodes 31*b* and 31*c* as negative electrodes. The positive electrode corresponds to the electrode 21*a* in FIGS. 6 and 7 or the electrode 21*c* in FIGS. 8 and 9. When detecting a change in capacitance between the electrodes in the above four detection patterns, the hand sensor 13 switches the combination of the electrodes which are used for detecting a change in capacitance. Thus, when capacitance between the electrodes is detected for the four combinations of the electrodes described above, the polarity of each electrode need not be changed, that is, the polarity of each electrode need not be changed to the positive side or the negative side, so that the time for detecting a hand can be reduced.

As described above, the hand sensor detects whether or not a hand is inserted into the hand insertion portion 3 at four points that are the front side, the back side, the left side, and the right side of the hand insertion portion 3, thereby being able to determine the position of a hand inserted into the hand insertion portion 3 in two dimensions that are the depth direction and the lateral direction. As a result, a specific position of a hand inserted in the hand insertion portion 3 can be detected.

The second embodiment also switches the combination of the pair of electrodes to be able to detect capacitance at four points using the four electrodes and prevent an increase in the number of electrodes.

The controller 14 controls the operation of the air blower 6 on the basis of information from the hand sensor 13. The controller 14 operates the air blower 6 when the hand sensor 13 detects that a hand is inserted into the hand insertion portion 3. The controller 14 stops the air blower 6 when the hand sensor 13 detects that a hand is not inserted in either the left or right side of the hand insertion portion 3.

The controller 14 controls distribution of supply of the high-pressure airflow to the front side nozzle 3*a* and the back side nozzle 3*b* on the basis of the combination of two electrodes with which a hand has been detected in the hand insertion portion 3. The controller 14 processes the hand detection signal information output from the hand sensor 13 to determine the combination of the two electrodes with which the hand has been detected and thus determine the position of the hand inserted in the hand insertion portion 3. When the hand sensor 13 detects that a hand is inserted only on the left side of the hand insertion portion 3 as viewed from the front side, the controller 14 performs control to feed the high-pressure airflow only to the left part of each of the front side nozzle 3*a* and the back side nozzle 3*b* as viewed from the front side. When the hand sensor 13 detects that a hand is inserted only on the right side of the hand insertion portion 3 as viewed from the front side, the controller 14 performs control to feed the high-pressure airflow only to the right part of each of the front side nozzle 3*a* and the back side nozzle 3*b* as viewed from the front side. When the hand sensor 13 detects that a hand is inserted on both left and right sides of the hand insertion portion 3 as viewed from the front side, the controller 14 performs control to feed the high-pressure airflow that is evenly distributed to both left and right sides of each of the front side nozzle 3*a* and the back side nozzle 3*b* as viewed from the front side. The hand can be dried efficiently by feeding the high-pressure airflow only to the position at which the hand is inserted.

A method of feeding the high-pressure airflow only to the left or right side of each of the front side nozzle 3*a* and the back side nozzle 3*b* as viewed from the front is not limited to a particular method. The front exhaust duct 12*a* and the back exhaust duct 12*b* may each be divided into left and right parts, in which case either the left or the right part of each of the front exhaust duct 12*a* and the back exhaust duct 12*b* can be closed under the control of the controller 14. Alternatively, the front exhaust duct 12*a* and the back exhaust duct 12*b* may each be divided into the left and right sides as viewed from the front, and the air blower may be provided separately for each of the left side and the right side of each of the front exhaust duct 12*a* and the back exhaust duct 12*b*, in which case the controller 14 may control the amount of high-pressure airflow generated in each air blower.

As described above, the hand dryer according to the second embodiment includes the electrode 31*a* on the left side of the front side wall of the hand insertion portion 3 and the electrode 31*b* on the right side of the front side wall, as viewed from the front side. The hand dryer further includes the electrode 31*c* on the left side of the back side wall of the hand insertion portion 3 and the electrode 31*d* on the right side of the back side wall, as viewed from the front side. The hand sensor 13 switches the combination of the two electrodes which are used for detecting a change in capacitance among four patterns and detects whether or not a hand is inserted into the hand insertion portion 3 at four points that are the front side, the back side, the left side, and the right side of the hand insertion portion 3, thereby being able to determine the position of a hand inserted into the hand insertion portion 3 in two dimensions that are the depth direction and the lateral direction.

The controller 14 controls the operation of the air blower 6 depending on the position of a hand in the hand insertion portion 3 detected by the hand sensor 13. That is, the controller 14 changes the distribution of supply of the high-pressure airflow to the left and right sides of each of the front side nozzle 3*a* and the back side nozzle 3*b* depending on the position of the hand inserted into the left or right side of the hand insertion portion 3, thereby being able to efficiently dry the hand that is inserted into a position on either the left half or the right half of the hand insertion portion 3.

Therefore, the hand dryer according to the second embodiment can avoid an increase in size and cost of the dryer by preventing an increase in the number of electrodes, and at the same time prevent misoperation due to water adhesion. Moreover, the hand dryer according to the second embodiment can be a user-friendly hand dryer that can perform control to achieve optimal operation corresponding to the position of a hand inserted.

Third Embodiment

Figure 11:
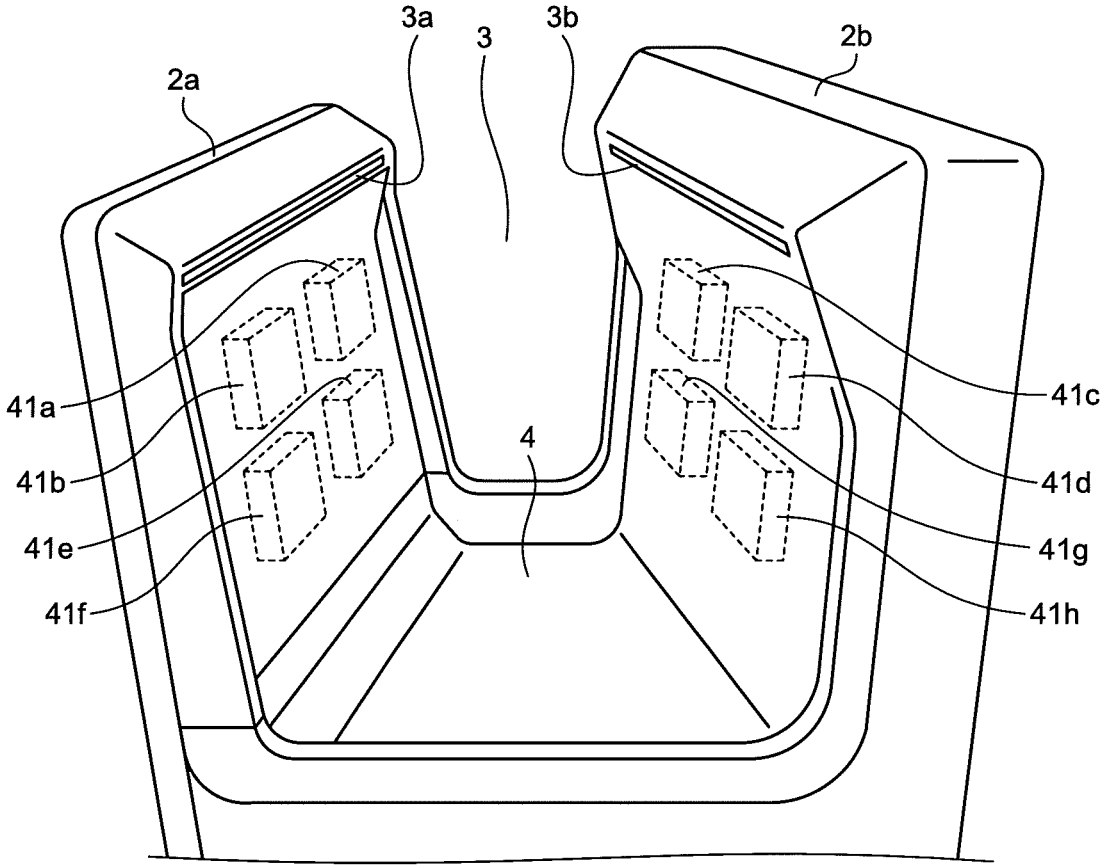
FIG. 11 is a top side view of a hand dryer according to a third embodiment of the present invention.

FIG. 11 is a top side view of a hand dryer according to a third embodiment of the present invention. Some parts in FIG. 11 are scaled to facilitate the understanding of the configuration of the hand dryer. In the hand dryer according to the third embodiment illustrated in FIG. 11, electrodes making up the hand sensor 13 are arranged in a manner corresponding to a combination of the arrangements adopted in the first and second embodiments. That is, a pair of electrodes on a plane is disposed vertically and laterally adjacent to each other on the plane.

Note that items not specifically described in the third embodiment are assumed to be similar to the items in the first embodiment, and functions and configurations identical to the functions and configurations in the first embodiment will be mentioned using the same reference numerals as the reference numerals assigned to the corresponding functions and configurations in the first embodiment. The functions and configurations of the hand dryer according to the third embodiment that are identical to the functions and configurations of the hand dryer 1 according to the first embodiment will not be described.

In the third embodiment, the hand sensor 13 includes electrodes 41*a*, 41*b*, 41*c*, 41*d*, 41*e*, 41*f*, 41*g*, and 41*h* as electrodes configuring the capacitive sensor of the mutual capacitance type. The electrode 41*a* is provided in the front protrusion 2*a* on an upper left side thereof as viewed from the front side. The electrode 41*b* is provided in the front protrusion 2*a* on an upper right side thereof as viewed from the front side. The electrode 41*c* is provided in the rear protrusion 2*b* on an upper left side thereof as viewed from the front side. The electrode 41*d* is provided in the rear protrusion 2*b* on an upper right side thereof as viewed from the front side. The electrode 41*e* is provided in the front protrusion 2*a* on a lower left side thereof below the electrode 41*a* as viewed from the front side. The electrode 41*f* is provided in the front protrusion 2*a* on a lower right side thereof below the electrode 41*b* as viewed from the front side. The electrode 41*g* is provided in the rear protrusion 2*b* on a lower left side thereof below the electrode 41*c* as viewed from the front side. The electrode 41*h* is provided in the rear protrusion 2*b* on a lower right side thereof below the electrode 41*d* as viewed from the front side.

Each pair of the electrodes 41*a* and 41*c*, the electrodes 41*b* and 41*d*, the electrodes 41*e* and 41*g*, and the electrodes 41*f* and 41*h* is disposed such that main surfaces of the electrodes face each other across the hand insertion portion 3. Each pair of the electrodes 41*a* and 41*e*, the electrodes 41*b* and 41*f*, the electrodes 41*c* and 41*g*, and the electrodes 41*d* and 41*h* is disposed such that the main surfaces of the electrodes are positioned vertically on a plane. Each pair of the electrodes 41*a* and 41*b*, the electrodes 41*c* and 41*d*, the electrodes 41*e* and 41*f*, and the electrodes 41*g* and 41*h* is disposed such that the main surfaces of the electrodes are positioned laterally on a plane. That is, in the third embodiment, four electrode pairs are disposed such that a first electrode and a second electrode in each electrode pair face each other across the hand insertion portion 3 in the depth direction of the body casing 2 and, in each electrode pair, one electrode is disposed vertically adjacent to an electrode in another electrode pair and laterally adjacent to an electrode in still another electrode pair on a plane, the vertically and laterally adjacent electrodes having a different polarity from that of the one electrode.

In the third embodiment, the electrodes 41*a*, 41*b*, 41*c*, 41*d*, 41*e*, 41*f*, 41*g*, and 41*h* are each in the shape of a rectangular parallelepiped and have the same shape and size. However, the shape and size of each electrode can be changed as appropriate.

In the third embodiment, the hand sensor 13 detects a hand by detecting capacitance between two of the electrodes 41*a*, 41*b*, 41*c*, 41*d*, 41*e*, 41*f*, 41*g*, and 41*h*. That is, the hand sensor 13 determines insertion of a hand and the position of the hand inserted into the hand insertion portion 3 by switching a combination of the two electrodes, which are used for detecting a change in capacitance, in turn among twelve patterns. The hand sensor 13 detects a change in capacitance between the two electrodes in twelve detection patterns that are a ninth pattern to a twentieth pattern.

In the ninth pattern, the hand sensor 13 detects capacitance between the electrodes 41*a* and 41*b* disposed laterally adjacent to each other on a plane at predetermined regular intervals, thereby detecting a change in capacitance between the electrodes 41*a* and 41*b* and detecting whether or not a hand is inserted into the upper front side of the hand insertion portion 3. In this case, the electrodes 41*a* and 41*b* correspond to the electrodes 21*c* and 21*d* in FIGS. 8 and 9, respectively. The electrodes 41*a* and 41*b* are disposed on the same plane.

In the tenth pattern, the hand sensor 13 detects capacitance between the electrodes 41*e* and 41*f* disposed laterally adjacent to each other on a plane at predetermined regular intervals, thereby detecting a change in capacitance between the electrodes 41*e* and 41*f* and detecting whether or not a hand is inserted into the lower front side of the hand insertion portion 3. In this case, the electrodes 41*e* and 41*f* correspond to the electrodes 21*c* and 21*d* in FIGS. 8 and 9, respectively. The electrodes 41*e* and 41*f* are disposed on the same plane.

In the eleventh pattern, the hand sensor 13 detects capacitance between the electrodes 41*a* and 41*e* disposed vertically adjacent to each other on a plane at predetermined regular intervals, thereby detecting a change in capacitance between the electrodes 41*a* and 41*e* and detecting whether or not a hand is inserted into a region on the front left side of the hand insertion portion 3 as viewed from the front side. In this case, the electrodes 41*a* and 41*e* correspond to the electrodes 21*c* and 21*d* in FIGS. 8 and 9, respectively. The electrodes 41*a* and 41*e* are disposed on the same plane.

In the twelfth pattern, the hand sensor 13 detects capacitance between the electrodes 41*b* and 41*f* disposed vertically adjacent to each other on a plane at predetermined regular intervals, thereby detecting a change in capacitance between the electrodes 41*b* and 41*f* and detecting whether or not a hand is inserted into a region on the front right side of the hand insertion portion 3 as viewed from the front side. In this case, the electrodes 41*b* and 41*f* correspond to the electrodes 21*c* and 21*d* in FIGS. 8 and 9, respectively. The electrodes 41*b* and 41*f* are disposed on the same plane.

In the thirteenth pattern, the hand sensor 13 detects capacitance between the electrodes 41*c* and 41*d* disposed laterally adjacent to each other on a plane at predetermined regular intervals, thereby detecting a change in capacitance between the electrodes 41*c* and 41*d* and detecting whether or not a hand is inserted into the upper back side of the hand insertion portion 3. In this case, the electrodes 41*c* and 41*d* correspond to the electrodes 21*c* and 21*d* in FIGS. 8 and 9, respectively. The electrodes 41*c* and 41*d* are disposed on the same plane.

In the fourteenth pattern, the hand sensor 13 detects capacitance between the electrodes 41*g* and 41*h* disposed laterally adjacent to each other on a plane at predetermined regular intervals, thereby detecting a change in capacitance between the electrodes 41*g* and 41*h* and detecting whether or not a hand is inserted into the lower back side of the hand insertion portion 3. In this case, the electrodes 41*g* and 41*h* correspond to the electrodes 21*c* and 21*d* in FIGS. 8 and 9, respectively. The electrodes 41*g* and 41*h* are disposed on the same plane.

In the fifteenth pattern, the hand sensor 13 detects capacitance between the electrodes 41*c* and 41*g* disposed vertically adjacent to each other on a plane at predetermined regular intervals, thereby detecting a change in capacitance between the electrodes 41*c* and 41*g* and detecting whether or not a hand is inserted into a region on the back left side of the hand insertion portion 3 as viewed from the front side. In this case, the electrodes 41*c* and 41*g* correspond to the electrodes 21*c* and 21*d* in FIGS. 8 and 9, respectively. The electrodes 41*c* and 41*g* are disposed on the same plane.

In the sixteenth pattern, the hand sensor 13 detects capacitance between the electrodes 41*d* and 41*h* disposed vertically adjacent to each other on a plane at predetermined regular intervals, thereby detecting a change in capacitance between the electrodes 41*d* and 41*h* and detecting whether or not a hand is inserted into a region on the back right side of the hand insertion portion 3 as viewed from the front side. In this case, the electrodes 41*d* and 41*h* correspond to the electrodes 21*c* and 21*d* in FIGS. 8 and 9, respectively. The electrodes 41*d* and 41*h* are disposed on the same plane.

In the seventeenth pattern, the hand sensor 13 detects capacitance between the electrodes 41*a* and 41*c* disposed to face each other across the hand insertion portion 3 at predetermined regular intervals, thereby detecting a change in capacitance between the electrodes 41*a* and 41*c* and detecting whether or not a hand is inserted into a region on the upper left side of the hand insertion portion 3 as viewed from the front side. In this case, the electrodes 41*a* and 41*c* correspond to the electrodes 21*a* and 21*b* in FIGS. 6 and 7, respectively.

In the eighteenth pattern, the hand sensor 13 detects capacitance between the electrodes 41*b* and 41*d* disposed to face each other across the hand insertion portion 3 at predetermined regular intervals, thereby detecting a change in capacitance between the electrodes 41*b* and 41*d* and detecting whether or not a hand is inserted into a region on the upper right side of the hand insertion portion 3 as viewed from the front side. In this case, the electrodes 41*b* and 41*d* correspond to the electrodes 21*a* and 21*b* in FIGS. 6 and 7, respectively.

In the nineteenth pattern, the hand sensor 13 detects capacitance between the electrodes 41*e* and 41*g* disposed to face each other across the hand insertion portion 3 at predetermined regular intervals, thereby detecting a change in capacitance between the electrodes 41*e* and 41*g* and detecting whether or not a hand is inserted into a region on the lower left side of the hand insertion portion 3 as viewed from the front side. In this case, the electrodes 41*e* and 41*g* correspond to the electrodes 21*a* and 21*b* in FIGS. 6 and 7, respectively.

In the twentieth pattern, the hand sensor 13 detects capacitance between the electrodes 41*f* and 41*h* disposed to face each other across the hand insertion portion 3 at predetermined regular intervals, thereby detecting a change in capacitance between the electrodes 41*f* and 41*h* and detecting whether or not a hand is inserted into a region on the lower right side of the hand insertion portion 3 as viewed from the front side. In this case, the electrodes 41*f* and 41*h* correspond to the electrodes 21*a* and 21*b* in FIGS. 6 and 7, respectively.

In the twelve detection patterns that are the ninth to twentieth patterns, the third embodiment uses the electrodes 41*a*, 41*d*, 41*f*, and 41*g* as positive electrodes and the electrodes 41*b*, 41*c*, 41*e*, and 41*h* as negative electrodes. The positive electrode corresponds to the electrode 21*a* in FIGS. 6 and 7 or the electrode 21*c* in FIGS. 8 and 9. When detecting a change in capacitance between the electrodes in the above twelve detection patterns, the hand sensor 13 switches the combination of the electrodes which are used for detecting a change in capacitance. Thus, when capacitance between the electrodes is detected for the twelve combinations of the electrodes described above, the polarity of each electrode need not be changed, that is, the polarity of each electrode need not be changed to the positive side or the negative side, so that the time for detecting a hand can be reduced.

As described above, the hand sensor detects whether or not a hand is inserted into the hand insertion portion 3 at twelve points that are the upper front side, the lower front side, the front left side, the front right side, the upper back side, the lower back side, the back left side, the back right side, the upper left side, the upper right side, the lower left side, and the lower right side of the hand insertion portion 3, thereby being able to determine the position of a hand inserted into the hand insertion portion 3 in three dimensions being the depth direction, the vertical direction, and the lateral direction. As a result, a specific position of a hand inserted in the hand insertion portion 3 can be detected.

The third embodiment also switches the combination of the pair of electrodes to be able to detect capacitance at twelve points using the eight electrodes and prevent an increase in the number of electrodes.

As with the first and second embodiments described above, the controller 14 controls the operation of the air blower 6 on the basis of information from the hand sensor 13. The controller 14 operates the air blower 6 when the hand sensor 13 detects that a hand is inserted into the hand insertion portion 3. The controller 14 stops the air blower 6 when the hand sensor 13 detects that a hand is not inserted in either the lower or upper side of the hand insertion portion 3.

The controller 14 controls distribution of supply of the high-pressure airflow to the front side nozzle 3*a* and the back side nozzle 3*b* on the basis of the combination of two electrodes with which a hand has been detected in the hand insertion portion 3. As with the first and second embodiments described above, the controller 14 can perform control to blow the high-pressure airflow to the position at which a hand has been detected by the hand sensor 13 in the hand insertion portion 3, and stop blowing of the high-pressure airflow to the position at which a hand is not detected by the hand sensor 13 in the hand insertion portion 3. The hand can be dried efficiently by feeding the high-pressure airflow only to the position at which the hand is inserted.

As described above, the hand dryer according to the third embodiment combines the function of the hand sensor 13 in the first embodiment and the function of the hand sensor 13 in the second embodiment, thereby being able to determine the position of a hand inserted into the hand insertion portion 3 in three dimensions that are the depth direction, the vertical direction, and the lateral direction. The position of a hand inserted into the hand insertion portion 3 can thus be detected more precisely so that the hand can be dried more efficiently.

The configuration illustrated in the above embodiment merely illustrates an example of the content of the present invention, and can thus be combined with another known technique or partially omitted and/or modified without departing from the scope of the present invention.

REFERENCE SIGNS LIST

1 hand dryer; 2 body casing; 2*a* front protrusion; 2*b* rear protrusion; 2*c* opening; 3 hand insertion portion; 3*a* front side nozzle; 3*b* back side nozzle; 4 water receiving portion; 5 drain tank; 6 air blower; 7 motor; 8 turbofan; 9 duct; 10 air inlet; 11 air filter; 12*a* front exhaust duct; 12*b* back exhaust duct; 13 hand sensor; 13*a*, 13*b*, 13*c*, 13*d*, 21*a*, 21*b*, 21*c*, 21*d*, 31*a*, 31*b*, 31*c*, 31*d*, 41*a*, 41*b*, 41*c*, 41*d*, 41*e*, 41*f*, 41*g*, 41*h* electrode; 14 controller; 101 processor; 102 memory.

The invention claimed is:

1. A hand dryer that removes water adhering to a hand inserted into a hand insertion portion with a high-pressure airflow blown from a nozzle, the hand dryer comprising:

the hand insertion portion formed in a recessed shape in a body casing;

an air blower provided in the body casing to generate the high-pressure airflow;

the nozzle provided on a wall of the hand insertion portion to transform the high-pressure airflow from the air blower into a high-speed airflow and blow the high-speed airflow into the hand insertion portion;

a hand sensor including a plurality of electrode pairs to detect a hand inserted into the hand insertion portion from a change in capacitance between two electrodes included in the plurality of electrode pairs, each of the plurality of electrode pairs consisting of a first electrode and a second electrode having different polarities to each other;

a processor to execute a program; and a memory to store the program which, when executed by the processor, performs processes of, driving the air blower based on a combination of the two electrodes with which a hand has been detected by the hand sensor.

2. The hand dryer according to claim 1, wherein the first electrode and the second electrode of at least one electrode pair among the plurality of electrode pairs are disposed to face each other across the hand insertion portion.

3. The hand dryer according to claim 1, wherein two of the electrode pairs are disposed such that the first electrode and the second electrode in each electrode pair face each other across the hand insertion portion in a depth direction of the body casing, and in each of the two electrode pairs, one electrode is disposed vertically adjacent to an electrode in another electrode pair on a plane, the vertically adjacent electrode having a polarity different from a polarity of the one electrode.

4. The hand dryer according to claim 1, wherein two of the electrode pairs are disposed such that the first electrode and the second electrode in each electrode pair face each other across the hand insertion portion in a depth direction of the body casing, and in each of the two electrode pairs, one electrode is disposed laterally adjacent to an electrode in another electrode pair on a plane, the laterally adjacent electrodes having different polarities to each other.

5. The hand dryer according to claim 1, wherein four of the electrode pairs are disposed such that the first electrode and the second electrode in each electrode pair face each other across the hand insertion portion in a depth direction of the body casing, and in each of the four electrode pairs, one electrode is disposed vertically adjacent to an electrode in another electrode pair and laterally adjacent to an electrode in still another electrode pairs on a plane, the vertically and laterally adjacent electrodes having a polarity different from a polarity of the one electrode.

6. The hand dryer according to claim 1, wherein the nozzle includes a front side nozzle provided on a front side wall of the hand insertion portion, and a back side nozzle provided on a back side wall of the hand insertion portion, and the processor controls distribution of supply of the high-pressure airflow to the front side nozzle and the back side nozzle based on a combination of the two electrodes with which a hand has been detected in the hand insertion portion.

7. The hand dryer according to claim 1, wherein the processor performs control to blow the high-pressure airflow from the nozzle to a position at which a hand has been detected by the hand sensor in the hand insertion portion, and stop blowing of the high-pressure airflow from the nozzle to a position at which a hand is not detected by the hand sensor in the hand insertion portion.

8. The hand dryer according to claim 2, wherein two of the electrode pairs are disposed such that the first electrode and the second electrode in each electrode pair face each other across the hand insertion portion in a depth direction of the body casing, and in each of the two electrode pairs, one electrode is disposed vertically adjacent to an electrode in another electrode pair on a plane, the vertically adjacent electrode having a polarity different from a polarity of the one electrode.

9. The hand dryer according to claim 2, wherein two of the electrode pairs are disposed such that the first electrode and the second electrode in each electrode pair face each other across the hand insertion portion in a depth direction of the body casing, and in each of the two electrode pairs, one electrode is disposed laterally adjacent to an electrode in another electrode pair on a plane, the laterally adjacent electrodes having different polarities to each other.

10. The hand dryer according to claim 2, wherein four of the electrode pairs are disposed such that the first electrode and the second electrode in each electrode pair face each other across the hand insertion portion in a depth direction of the body casing, and in each of the four electrode pairs, one electrode is disposed vertically adjacent to an electrode in another electrode pair and laterally adjacent to an electrode in still another electrode pairs on a plane, the vertically and laterally adjacent electrodes having a polarity different from a polarity of the one electrode.

* * * * *